United States Patent [19]

Countryman et al.

[11] 4,350,449

[45] Sep. 21, 1982

[54] RESISTIVE RIBBON PRINTING APPARATUS AND METHOD

[75] Inventors: Gerald P. Countryman; Ronald G. Findlay, both of San Jose, Calif.

[73] Assignee: International Business Machines Corporation, Armonk, N.Y.

[21] Appl. No.: 162,295

[22] Filed: Jun. 23, 1980

[51] Int. Cl.[3] ..... B41J 3/20

[52] U.S. Cl. ..... 400/120; 346/76 R; 219/216; 400/241.1

[58] Field of Search ..... 400/120; 346/76 R, 76 PH; 219/216

[56] References Cited

U.S. PATENT DOCUMENTS

| | | | |
|---|---|---|---|
| 3,725,898 | 4/1973 | Canton | 219/216 X |
| 3,744,611 | 7/1973 | Montanari et al. | 400/120 |
| 3,874,493 | 4/1975 | Boyd | 400/120 |
| 3,934,695 | 1/1976 | Kovalick | 400/120 |
| 3,975,707 | 8/1976 | Ito et al. | 346/76 PH |
| 4,113,391 | 9/1978 | Minowa | 400/120 |
| 4,149,171 | 4/1979 | Sato et al. | 400/120 X |
| 4,168,421 | 9/1979 | Ito | 346/76 PH X |
| 4,219,824 | 8/1980 | Asai | 400/120 X |
| 4,236,834 | 12/1980 | Hafer et al. | 346/76 R X |
| 4,262,188 | 4/1981 | Beach | 219/216 |

FOREIGN PATENT DOCUMENTS

| | | | |
|---|---|---|---|
| 52-37053 | 3/1977 | Japan | 400/120 |
| 54-97438 | 8/1979 | Japan | 400/120 |
| 54-148152 | 11/1979 | Japan | 400/120 |

OTHER PUBLICATIONS

IBM Technical Disclosure Bulletin, "Resistive Ribbon Printing on Typewriter Keys", Wilbur, vol. 20, No. 12, May 1978, p. 5314.

IBM Technical Disclosure Bulletin, "Thermal Print Head Power Supply Regulator", Heiling et al., vol. 22, No. 5, Oct. 1979, p. 2023.

IBM Technical Disclosure Bulletin, "Constant Current Driver Multiplexing Scheme for Electrothermal Printing", Findlay, vol. 23, No. 8, Jan. 1981, pp. 3875-3876.

*Primary Examiner*—Ernest T. Wright, Jr.

*Attorney, Agent, or Firm*—Otto Schmid, Jr.

[57] ABSTRACT

A printing apparatus and method employs a print head comprising a plurality of aligned printing electrodes. The print head is movable relative to a ribbon comprising a resistive layer, a conductive layer, and a layer of thermally transferrable ink to provide a desired image on conventional paper by selective energization of the printing electrodes. Each of the electrodes is energizable by a control circuit which includes a constant current driver for each printing electrode and a regulating circuit which permits a selected current to be maintained in each of the energized drivers.

11 Claims, 6 Drawing Figures

RESISTIVE RIBBON PRINTING APPARATUS AND METHOD

DESCRIPTION

1. Technical Field

This invention relates to a non-impact printing apparatus and method and, more particularly, to an electrothermic printing apparatus and method wherein printing is effected by momentarily selectively energizing an array of electrodes with a constant predetermined current to cause discrete areas of a transfer medium to be resistance heated and release a thermal sensitive transfer material.

One object of this invention is to provide a printing apparatus and method which employs a drive circuit which produces a constant predetermined current without regard to the number of electrodes that are energized at any one time, and also, without regard to the variation in contact resistance between individual electrodes and the transfer medium.

Another object is to provide a resistive ribbon type printing apparatus having a drive circuit so configured that good printing can be achieved with a variable number of electrodes energized without regard to any nonlinear circuit properties of the ribbon.

2. Background Art

Various electrothermic printing apparatus and methods have heretofore been proposed to momentarily heat selected areas of a ribbon for imaging a record medium, such as conventional paper. The following constitute the most pertinent prior art presently known to applicants relating to their resistive ribbon printing apparatus and method. U.S. Pat. No. 3,744,611 discloses a resistive ribbon printing apparatus and method in which a ribbon having a conductive layer interposed between a resistive layer and a thermal transfer layer is utilized. The conductive layer provides a short current path through the resistive layer in order to maintain localized heating to insure good resolution in the image that is transferred to the paper.

U.S. Pat. Nos. 3,725,898 and 4,168,421 are illustrative of thermal electric printing apparatus and drive circuits used for the printer. For example, in U.S. Pat. No. 3,725,898, the temperature of each print head character matrix is sampled prior to the print cycle for that particular character with a circuit which includes a constant current source and a sample and hold circuit. The power that is applied to the character matrix during the print cycle is then adjusted in such a manner as to achieve a predetermined temperature during the print cycle. U.S. Pat. No. 4,168,421 utilizes a voltage compensation in the drive circuit for detecting changes in the magnitude of the supply voltage and, in turn, controls the duration of the current driving pulses to stabilize the printing density of each character formed on the printing medium.

In spite of their critical design requirements and their relative complexity, the prior art control techniques have not been entirely satisfactory in providing the required print quality due to variations in print density caused by varying the number of electrodes energized at a particular time.

DISCLOSURE OF INVENTION

According to the invention, a resistive ribbon printing apparatus has a print head that provides high resolution printing by use of a transfer medium comprising a resistive layer, a conductive layer and a thermally sensitive transfer layer (for imaging conventional paper) or comprising a resistive layer and a conductive layer (for imaging thermally sensitive paper). Aligned printing electrodes in the print head are selectively energized to cause current of a constant predetermined magnitude to flow via the resistive layer to the conductive layer so that heat is generated locally in the transfer medium for imaging the record medium. Selective energization for the printing electrodes is provided by a control circuit which includes a constant current driver for each printing electrode and a regulating circuit which permits a predetermined current to be maintained in each of the energized drivers. This control circuit is designed so that any combination of print electrode drivers can be active at one time and still maintain a constant drive current to each print electrode. This drive current is adjustable and can be accurately preset to a desired level.

BRIEF DESCRIPTION OF DRAWING

In the accompanying drawing forming a material part of this disclosure.

BEST MODE FOR CARRYING OUT THE INVENTION

Figure 1:
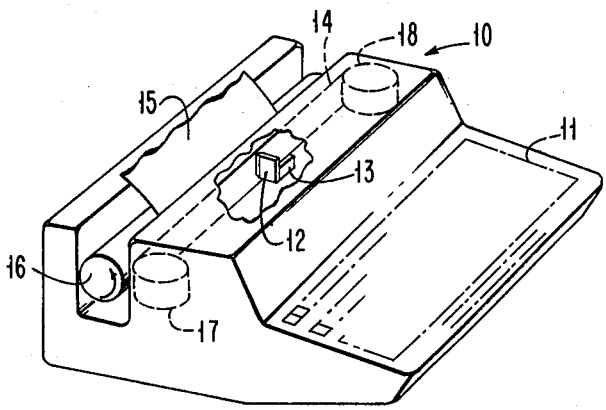
FIG. 1 is a perspective view of a printing apparatus embodying the invention.

The printing apparatus embodying the invention is shown illustratively associated with a typewriter-like printing apparatus 10 comprising a conventional keyboard 11. The keyboard 11 generates coded data to control a print head 12. Print head 12 is mounted in a carriage 13 that is movable transversely of apparatus 10 but parallel to the feed path of a ribbon-like transfer medium 14. Print head 12 presses ribbon 14 against a record medium 15 that is backed up by a platen 16. As in conventional typewriters, ribbon 14 in unwound from a supply reel 17 and wound onto a take-up reel 18 and record medium 15 is fed upwardly in a direction at right angles to the direction of movement of ribbon 14 and print head 12.

Figure 2:
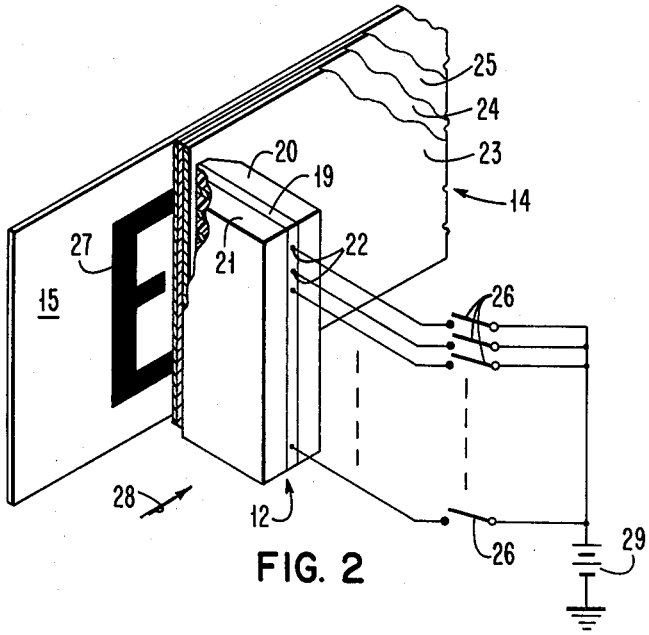
FIG. 2 is a fragmentary perspective view, to enlarged scale, of the print head, ribbon and record member shown in FIG. 1 together with illustrative electrical circuitry schematically indicated therein.
Figure 3:
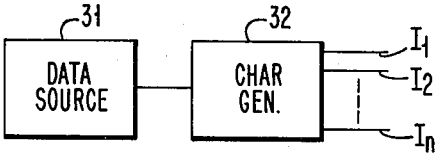
FIG. 3 is a diagrammatic block diagram of circuits for generating character forming signals.

As best shown in FIG. 2 and according to the invention, print head 12 comprises a relatively thin insulating layer 19 that is interposed between and bonded to facing flat surfaces of two rectangular plate-like elements 20 and 21. A plurality of printing electrodes 22 are embedded within insulating layer 19 such that the tip ends **22*a* of the electrodes 22 are vertically spaced equal distances apart and exposed through the active end of the print head 12, that is, the end which contacts the resistive ribbon 14. Ribbon 14 consists of a resistive layer 23, a conductive layer 24, and a layer 25 of thermally transferrable marking material such as heat fusable ink or the like. In the preferred embodiment of resistive ribbon 14, the conductive layer 24 is aluminum. The active end of print head 12 presses against resistive layer 23 with a force sufficient to maintain layer 25 in effective contact with the record medium 15 while it is back-stopped in contact with platen 16. Referring to FIG. 2, the printing electrodes 22 are connected to and selectively energizable by any suitable means. For sake of simplified illustration, this energizing means is depicted as a plurality of selectively closable switches 26 (one for each electrode 22) connected to a common voltage source 29**.

Figure 4:
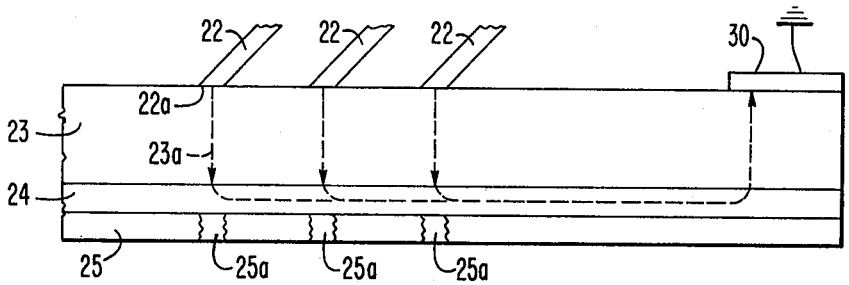
FIG. 4 is a diagrammatic view showing the current flow path from the print electrodes through the resistive layer and conductive layer back to the ground plane of the system.

In operation, upon closure of one of the switches 26 and consequent energization of the corresponding printing electrode 22, current will flow from the electrode 22 via the resistive layer 23 and the conductive layer 24 to a common return path providing element 30 (FIG. 4). Element 30 is suitably connected to a reference potential such as ground. As current flows through layer 23, the power dissipated will cause heating of that portion 23*a* (FIG. 4) of the layer 23 that extends from the tip end 22*a* of the electrode 22 to the adjacent portion of the conductive layer 24. This localized heating of the resistive layer 23 by the electrical power dissipation will cause melting of the thermally transferrable material in the contiguous portion 25*a* of layer 25 and thereby form an image 27 on record medium 15.

By concurrent energization of selected ones of the printing electrodes 22 during movement of print head 12 in the direction of arrow 28 relative to ribbon 14 and record medium 15, a desired pattern such as character 27 can be imprinted on the record medium 15. In a particular embodiment, forty electrodes 22 were provided, and this print head produced characters such as character 27 with a resolution approaching that produced by engraved type printing.

Figure 5:
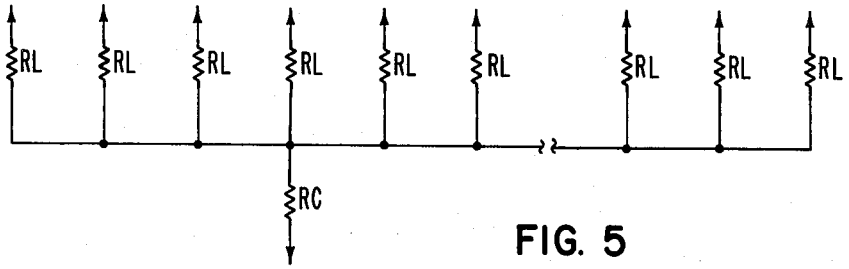
FIG. 5 is a diagrammatic schematic view showing the distributed resistance in the overall ribbon circuit.

The simplified diagram of the overall ribbon circuit of FIG. 5 can be used to show the distribution of voltage losses which occur in the ribbon circuit during a printing operation. Each electrode circuit has an equivalent resistance RL and the common current return path has an equivalent resistance RC. The equivalent resistance RL of each electrode 22 circuit comprises one series component due to the contact resistance between electrode 22 and ribbon 14, the series resistance of portion 23*a* of resistive layer 23, the interface resistance between resistive layer 23 and conductive layer 24, and the resistance of conductive layer 24. The equivalent resistance RC of the common current return path includes similar components since the return current path extends along the conductive layer 24, through the interface to the resistive layer 23, through the resistive layer 23, and through the contact resistance to return element 30. Thus, the drop across the equivalent return path resistance RC varies depending on the number of electrodes 22 energized. In addition, many of the individual components making up the equivalent resistances may vary due to material variations, manufacturing tolerances and/or environmental conditions. These factors contribute to the difficulty in obtaining suitable control which produces uniformly acceptable print quality. In addition, in the preferred embodiment in which the conductive layer 24 is aluminum, a thin layer of insulating aluminum oxide naturally grows on the aluminum surface between the aluminum and the resistive layer 23. This thin oxide layer further complicates the drive circuit since the oxide layer acts as a nonlinear circuit element, which requires a minimum voltage to be present across it before any current can flow through it. However, our control circuit also compensates for this factor so that the printer can take advantage of another effect that the oxide layer appears to cause. This effect of the insulating oxide layer is to concentrate the heating in the ribbon 14 in the area adjacent to the aluminum conductive layer 24, thus enhancing the resolution in the printing operation.

The signals to provide the concurrent energization of the selected ones of printing electrodes 22 are provided by data source 31. Data source 31 may comprise signals generated by actuating a key from keyboard 11 during an interactive typewriter mode or, in a power typing mode, the data source 31 may comprise previously recorded character signals. The character signals from data source 31 are coupled to character generator 32 to generate the signals $I_l$ to $I_n$ to provide the character pattern designated by the data source character code.

Figure 6:
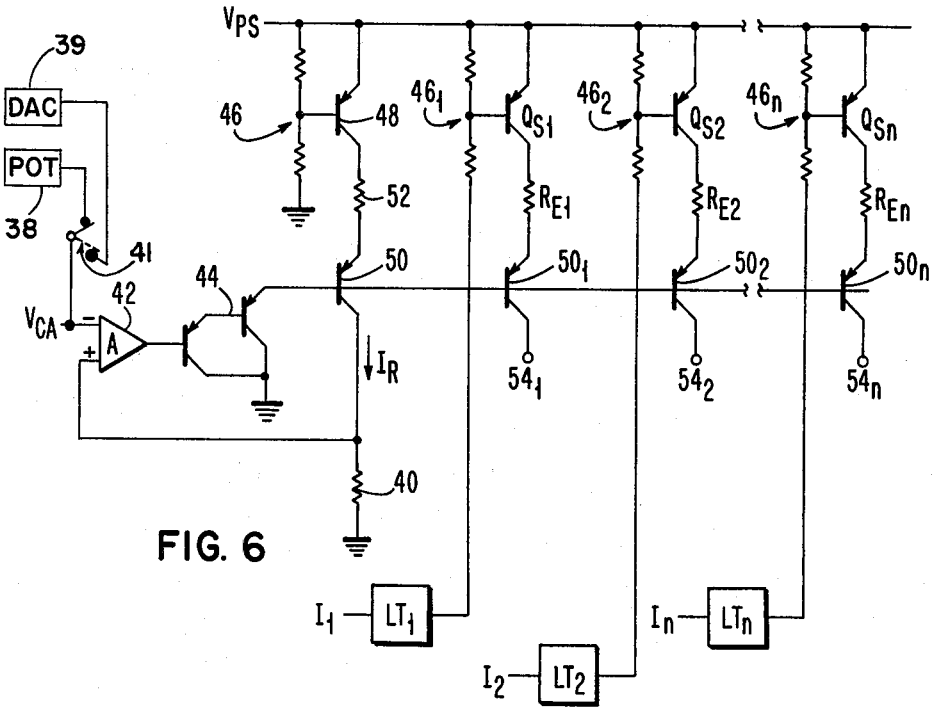
FIG. 6 is a schematic view of the constant current drive circuit for the print head shown in FIG. 1.

According to an important feature of the invention, the drive circuit for energizing each of the printing electrodes 22 comprises a constant current driver. The drive circuit to accomplish the consistent heating effect is shown in FIG. 6. The circuit includes a regulating circuit comprising a current sampling resistor 40, an operational amplifier 42, a high-power Darlington transistor 44, and a reference current source 46. The reference current source 46 comprises switching transistor 48, resistor 52, and current driver transistor 50. Similar current sources 46, , $46_2$ . . . $46_n$ are provided with one current source circuit to control each of the printing electrodes 22. The control is provided by the logic level input signals $I_1$, $I_2$ . . . $I_n$ from character generator 32 which are translated to the proper level to provide signals. Lever translators $LT_1$, $LT_2$ . . . $LT_n$ individually control one of the current source circuits 46 and the current source outputs $54_1$, $54_2$ . . . $54_n$ individually drive one of the print electrodes 22 and print head 12.

The regulating circuit provides a reference voltage to the bases of all the current source output transistors $50_1$, $50_2$ . . . $50_n$ including transistor 50. The regulating circuit functions to maintain the voltage drop across resistor 40 equal to the reference voltage $V_{CA}$ which is coupled to the inverting input of operational amplifier 42. Voltage $V_{CA}$ can be set by any suitable means such as a 10 turn potentiometer 38 which is suitably mounted for access by the operator. If desired, the voltage $V_{CA}$ can be derived from an outside signal source, such as from a digital to analog converter 39, for example. Switch means 41 is for voltage $V_{CA}$.

The constant current drivers function as follows. Operational amplifier 42, Darlington transistor 44, and transistor 50, in conjunction with emitter resistor 52 and collector resistor 40, form a closed loop amplifier circuit. In this circuit, the collector current $I_R$ is equal to the emitter current flowing through emitter resistor 52 times the alpha of the transistor 50. In a resonable transistor, the value of alpha is close to one, so to a first approximation, the collector current will be equal to the emitter current. The emitter current flowing through resistor 52 will be determined by Ohm's law according to the voltage across it. The voltage across resistor 52 will be equal to the voltage difference between the power supply voltage, $V_{PS}$, and the voltage at the base transistor 50, less the saturation drop across transistor 48 and the base-emitter voltage of transistor 50. The closed loop amplifier circuit functions to maintain the voltage across current sampling resistor 40 to be equal to reference voltage $V_{CA}$. This is accomplished by controlling the voltage on the base of transistor 50 so as to achieve the necessary voltage drop between voltage $V_{PS}$ and the base voltage to cause the desired current to flow through emitter resistor 52. The value of current sampling resistor 40 can be chosen to provide a convenient scaling between the reference voltage $V_{CA}$ and the reference current $I_R$.

Each of the constant current driver circuits is configured identically to the reference current driver. Control of the output collector current from each of the output transistors $50_1$, $50_2$, . . . , $50_n$, is provided by switching transistors $QS_1$, $QS_2$, . . . , $QS_n$. These switch transistors $QS_1$, $QS_2$, . . . , $QS_n$ are controlled by logic input signals $I_1$, $I_2$, . . . , $I_n$ acting through level translators $LT_1$, $LT_2$, . . . , $LT_n$. For each circuit in which the corresponding switch transistor $QS_1$, $QS_2$, . . . , $QS_n$ is ON, emitter current will flow through the switch transistor $QS_1$, $QS_2$, . . . , $QS_n$, through the emitter resistor $RE_1$, $RE_2$, . . . , $RE_n$, and into the output transistor emitter. The collector current will again, to a first approximation, be equal to the emitter current, which again is determined by the value of the emitter resistor $RE_1$, $RE_2$, . . . , $RE_n$ and the voltage between the power supply and the output transistor base. If the emitter resistors $RE_1$, $RE_2$, . . . , $RE_n$ are chosen to be of the same value as emitter resistor 52, then the output collector current of each transistor $50_1$, $50_2$, . . . , $50_n$, for which the switch transistor $QS_1$, $QS_2$, . . . , $QS_n$ is ON will be equal to the reference current $I_R$. As the control voltage $V_{CA}$ is changed, the reference current $I_R$ will change accordingly, and the output current from each output transistor $50_1$, $50_2$, . . . , $50_n$ will closely track this reference current $I_R$. The output impedance of a transistor collector is high, so the output current will be constant over a wide range of output voltage. Thus, any combination of print electrode drivers can be active at one time within the design limits and still maintain a constant current in each print electrode 22, and the value of the current can be accurately preset by setting $V_{CA}$.

The drive circuit shown in FIG. 6 provides the predetermined constant current from the collectors of transistors $50_1$, $50_2$, . . . , $50_n$ to the desired selected electrodes 22 of FIGS. 2 and 4. The currents generated, selected and controlled by the circuits of FIG. 6 are utilized by the current paths illustrated in FIGS. 2 and 4. Once the desired currents are allowed to flow in the selected current paths of the ribbon 14, localized heating occurs in the desired areas of the ribbon 14, thus melting the thermally transferrable material and forming an image 27 on the record medium 15.

It will be recognized by those skilled in the art that our method and apparatus is not restricted to character printing. Image data can also be printed and, in this case, character generator 32 is not required since digital data defining the image can be supplied directly from data source 31. A higher speed printer can be produced by providing a print head which extends the full width of the print sheet. In this case, movement of the print head is not required, since the print sheet can be moved transverse to the print head, either continuously or incrementally, as the print electrodes are selectively energized to produce printed characters and/or images. The printer can also be used to image thermally sensitive paper by eliminating the ink layer 25 from ribbon 14.

While the invention has been particularly shown and described with reference to a preferred embodiment thereof, it will be understood by those skilled in the art that various changes in the form and details may be made therein without departing from the spirit and scope of the invention.

Having thus described our invention, what we claim as new, and desire to secure by Letters Patent, is:

1. A method of marking a record medium comprising the steps of:

providing a transfer medium consisting of a resistive layer, a conductive layer and a thermally transferrable marking material layer;

providing a print head comprising a plurality of spaced printing electrodes disposed in close proximity to said transfer medium;

interposing the transfer medium between the record medium and the print head with the resistive layer adjacent the print head; and selectively energizing said printing electrodes to cause current of a constant predetermined magnitude to flow between each selected print electrode and said conductive layer to produce heating in the resistive layer and thereby heat the adjacent localized area of said marking material layer for causing transfer of marking material from the marking material layer to the record medium such that uniform marking can be effected regardless of the number of electrodes simultaneously selectively energized and regardless of difference in contact resistance between said printing electrodes and said transfer medium.

2. The method according to claim 1, including the steps of:

producing relative motion between the print head, the record medium, and/or the transfer medium; and moving the record medium in a direction generally transversely of the print head.

3. The method according to claim 1, wherein said plurality of spaced printing electrodes are disposed in at least one line, said method including the step of moving the print head relative to the transfer medium and record medium in a direction which is generally at right angles to said at least one line.

4. The method according to claim 1, characterized in that the conductive layer comprises a thin layer of aluminum.

5. A method of marking a record medium comprising the steps of:

providing a transfer medium comprising a resistive layer and a conductive layer;

providing a print head comprising a plurality of spaced printing electrodes disposed in close proximity to said transfer medium;

interposing the transfer medium between the record medium and the print head with the resistive layer adjacent the print head; and selectively energizing said printing electrodes to cause current of a constant predetermined magnitude to flow between each selected print electrode and said conductive layer to produce heating in the resistive layer and thereby heat the adjacent localized area of said record medium such that uniform marking can be effected regardless of the number of electrodes simultaneously selectively energized and regardless of the difference in contact resistance between said printing electrodes and said transfer medium.

6. Apparatus for marking a record medium comprising:

a transfer medium consisting of a resistive layer, a conductive layer and a thermally transferrable marking material layer;

a print head comprising a plurality of spaced printing electrodes disposed in close proximity to said transfer medium;

means for interposing the transfer medium between the record medium and the print head with the resistive layer adjacent the print head; and means for selectively energizing said printing electrodes to cause current of a constant predetermined magnitude to flow between each selected print electrode and said conductive layer to generate resistance heating in the resistive layer and thereby heat the adjacent localized area of said marking material layer for causing transfer of marking material from the marking material layer to the record medium such that uniform marking can be effected regardless of the number of electrodes simultaneously selectively energized and regardless of the difference in contact resistance between said printing electrodes and said transfer medium.

7. The apparatus according to claim 6 additionally comprising:

means for moving the print head relative to the transfer medium and record medium; and means for moving the record medium in a direction generally transversely of the print head.

8. Apparatus according to claim 7, wherein said plurality of spaced printing electrodes are uniformly spaced and are disposed in at least one line which is generally at right angles to the direction of movement of the print head.

9. The apparatus according to claim 6 wherein said conductive layer comprises a thin layer of aluminum.

10. The apparatus according to claim 6 wherein said means for selectively energizing said printing electrodes includes drive circuit means comprising:

a constant current driver circuit including an output transistor for energizing a printing electrode;

a source of a reference voltage; and a regulating circuit comprising a current sampling resistor for sensing the output of said output transistor and a closed loop amplifier circuit to maintain the voltage across said current sampling resistor equal to said reference voltage.

11. The apparatus according to claim 10 additionally comprising:

means for setting said reference voltage to a predetermined voltage level.

* * * * *